US010804056B2

(12) United States Patent
Strand et al.

(10) Patent No.: US 10,804,056 B2
(45) **Date of Patent: *Oct. 13, 2020**

(54) ELECTRICAL SWITCH

(71) Applicant: ABB Oy, Helsinki (FI)

(72) Inventors: Fredrik Strand, Vaasa (FI); Mikko Välivainio, Vassa (FI); Jukka Lintamo, Vaasa (FI); Juha Soldan, Vaasa (FI)

(73) Assignee: ABB Oy, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 16/386,641

(22) Filed: Apr. 17, 2019

(65) Prior Publication Data

US 2019/0326083 A1 Oct. 24, 2019

(30) Foreign Application Priority Data

Apr. 24, 2018 (EP) ..... 18168975

(51) Int. Cl.
*H01H 33/06* (2006.01)
*H01H 33/10* (2006.01)
(Continued)

(52) U.S. Cl.
CPC ..... *H01H 33/06* (2013.01); *H01H 33/10* (2013.01); *H01H 33/14* (2013.01); *H01H 33/182* (2013.01); *H01H 33/64* (2013.01)

(58) Field of Classification Search
CPC ..... H01H 33/06; H01H 33/10; H01H 33/14; H01H 33/182; H01H 33/596; H01H 9/443; H01H 9/346; H01H 9/362; H01H 9/32
(Continued)

(56) References Cited

U.S. PATENT DOCUMENTS 4,677,266 A * 6/1987 Belbel ..... H01H 9/32 218/117
4,801,772 A * 1/1989 Bratkowski ..... H01H 9/32 218/117
(Continued)

FOREIGN PATENT DOCUMENTS

EP 1017074 A1 7/2000
EP 2650894 A1 10/2013
(Continued)

OTHER PUBLICATIONS

Translation of JP 2013-242977 (Original document published Dec. 5, 2013) (Year: 2013).*
(Continued)

*Primary Examiner* — Edwin A. Leon
*Assistant Examiner* — William A Bolton
(74) *Attorney, Agent, or Firm* — Taft Stettinius & Hollister LLP; J. Bruce Schelkopf

(57) ABSTRACT

An electrical switch. The electrical switch includes at least one fixed contact and a movable contact contacting the fixed contact. At least one shutter element is arranged to move in synchronism with the movable contact. The shutter element is positioned in an extended position between the fixed contact and the movable contact and in a contracted position outside the patch of the movable contact allowing the movable contact to turn from the open position to the closed position.

10 Claims, 14 Drawing Sheets

Figure 1:
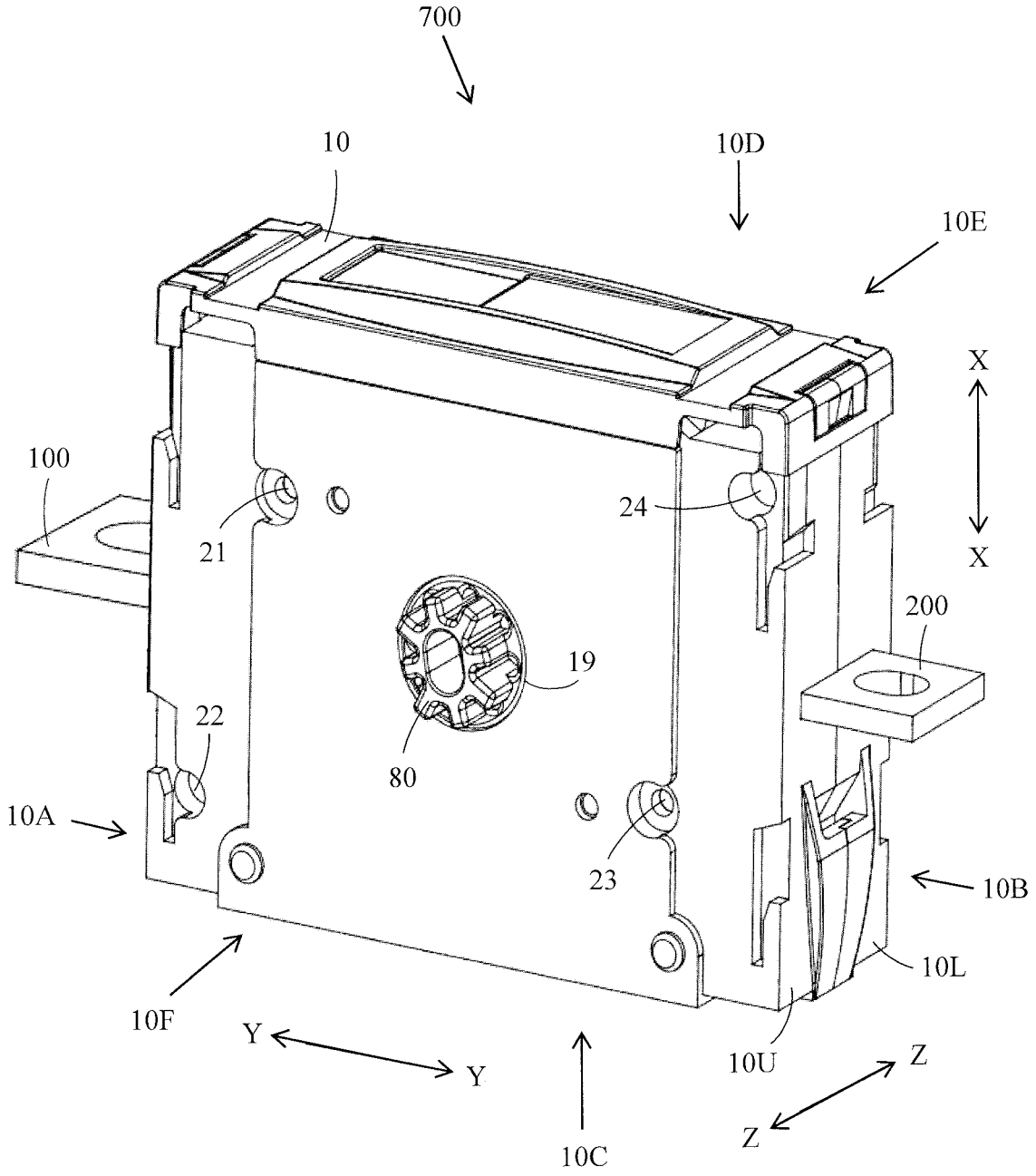

(51) Int. Cl.
*H01H 33/14* (2006.01)
*H01H 33/18* (2006.01)
*H01H 33/64* (2006.01)

(58) Field of Classification Search
USPC .... 200/50.22, 50.34, 447, 564, 254; 218/26, 218/23, 22, 25, 27, 32, 38, 113, 146, 149, 218/117
See application file for complete search history.

(56) References Cited

U.S. PATENT DOCUMENTS

| | | | | |
|---|---|---|---|---|
| 4,880,948 | A * | 11/1989 | Kandatsu | H01H 9/32 218/117 |
| 6,265,685 | B1 | 7/2001 | Faure et al. | |
| 9,299,509 | B2 * | 3/2016 | Coquil | H01H 9/443 |
| 9,437,376 | B2 * | 9/2016 | Mattlar | H01H 9/443 |
| 2014/0048513 | A1 * | 2/2014 | Sato | H01H 33/06 218/117 |
| 2014/0346144 | A1 | 11/2014 | Coquil et al. | |

FOREIGN PATENT DOCUMENTS

| | | | | |
|---|---|---|---|---|
| EP | 2980821 | A1 | 2/2016 | |
| FR | 1311209 | A | 12/1962 | |
| JP | 2013242977 | * | 12/2013 | H01H 9/44 |
| WO | 2014170529 | A1 | 10/2014 | |

OTHER PUBLICATIONS

European Patent Office, Search Report issued in corresponding Application No. 18168975.3, completed Aug. 3, 2018, 2 pp.

* cited by examiner

ELECTRICAL SWITCH

FIELD

The invention relates to an electrical switch.

BACKGROUND

There are a variety of electrical switches on the market with fixed and movable contacts. The movable contacts make connections between the stationary contacts. The electrical switch may comprise fixed contacts and a movable contact that performs coupling and disconnection between the fixed contacts. The load may be connected to a fixed contact and the power source may be connected to another fixed contact.

Electrical switches may be provided with bumper contacts or blade contacts. The contact in the bumper contact structure is pressed to the fixed contacts. The movable contact may consist of blades hinged at one end to a fixed contact, whereby the other end of the blades acts as a separating part. A blade contact construction can also be implemented with an opening at the opposite ends of the blades. A center portion of the blades may be connected to a rotating roller, whereby each outer end of the blades forms an opening contacting the fixed contacts. The blades may on the other hand move linearly into contact with the fixed contacts and out of contact with the fixed contacts. Blade contacts are normally used in switches designed for a nominal current over 63 ampere and bumper contacts are used in switches designed for smaller currents.

Electrical switches may further be provided with one or more extinguishing apparatuses through which the moving contact may pass when being disconnected from the fixed contacts. The extinguishing apparatus provides a prolonged path for the arc building up between the moving contact and the fixed contact when the moving contact is disconnected from the fixed contact. The prolonged path will help to cool down the arch and to extinguish the arc. The arc is erosive and may therefore damage parts that are in the vicinity of the arc.

The extinguishing apparatus may be provided with one or more extinguishing plates having a general shape of a lying letter U. A passage is thereby formed through a middle portion of the extinguishing plates. An outer end of the movable contact may move through the passage when being disconnected from the fixed contact.

Electrical switches may further be provided with one or more permanent magnets helping to direct the arc into the extinguishing apparatus.

EP 2 650 894 discloses an electric current switch apparatus comprising a movable contact and a stationary contact for being contacted by the movable contact. The switch comprises further one or more quenching plates and a permanent magnet for directing an arc to the quenching plates. The arc is formed when the contacts are separated from each other. The permanent magnet is positioned radially outside the extinguishing plate in the vicinity of the fixed contact.

FR 1311209 discloses an electric switch comprising two movable contacts and two fixed contacts. The movable contacts are supported on opposite ends of a longitudinal bushing. Each fixed contact is positioned on an outer end of an insulator. The bushing extends perpendicularly over a rail. A center portion of the bushing is supported on a metal flap gliding in the rail. The bushing and thereby also the movable contacts move with the metal flap in the rail between a closed position in which the movable contacts make contact with the fixed contacts and an open position in which the movable contacts are at a distance from the fixed contacts. The metal flap is attached to an articulated arm system for moving the metal flap and thereby also the bushing in the rail. An auxiliary flap having a semi-cylindrical shape and being rotatable around an axis is arranged in connection with each movable contact in the open position of the movable contact. The auxiliary flaps may be activated with a manual control to rotate into a position against the metal flap on the rail in the open position of the movable contact when the movable contacts are to be inspected.

US 2014/03461144 discloses an electrical switching device which comprises at least one double breaking pole provided with two fixed contacts that cooperate with two moving contacts arranged so as to move in a breaking plane and define, with every fixed contact a breaking zone. The device comprises a permanent magnet housed in an insulating holder arranged in the immediate environment, next to each breaking zone, symmetrically with respect to the breaking plane and oriented so as to generate a magnetic excitation vector parallel to the breaking plane so that the induced electromagnetic force moves and stretches every electric arc, generated when opening the electrical circuit, in a direction perpendicular to the breaking plane, leading to the extinction of the electric arc regardless of the polarity of the magnet and/or of the current.

SUMMARY

The invention relates to an improved electrical switch.

The electrical switch according to the invention is defined in claim 1.

The electrical switch comprises:

at least one fixed contact, a movable contact being movable between a closed position in which the movable contact makes contact to the fixed contact and an open position in which the movable contact is electrically isolated from the fixed contact.

The electrical switch is characterized by at least one shutter element being movable in synchronism with the movable contact between an extended position in which the shutter element is positioned between the fixed contact and the movable contact when the movable contact is in the open position, and a contracted position in which the shutter element is positioned outside the patch of the movable contact allowing the movable contact to turn from the open position to the closed position.

The shutter element moves into the extended position between the fixed contact and the movable contact when the movable contact moves from the closed position to the open position. The shutter element will thus close the direct path between the fixed contact and the opening moving contact. The arc is thus eliminated from taking the shortest path from the fixed contact to the opening movable contact.

The shutter element will in an embodiment in which the electrical switch further comprises an extinguishing apparatus force the arc to the extinguishing apparatus. The shutter element eliminates the arc from taking a short cut between the fixed contact and the opening movable contact outside the extinguishing apparatus.

The electrical switch according to the invention provides a compact and cost effective solution.

One further advantage with the shutter element seems to be that the fixed contact stays cleaner compared to a situation in which no shutter element is used.

The electrical switch according to the invention is especially suitable to be used as a switch for DC currents. The nominal current could be in the range of 100 to 1600 amperes and the nominal voltage could be up to at least 1500V.

DRAWINGS

Figure 2:
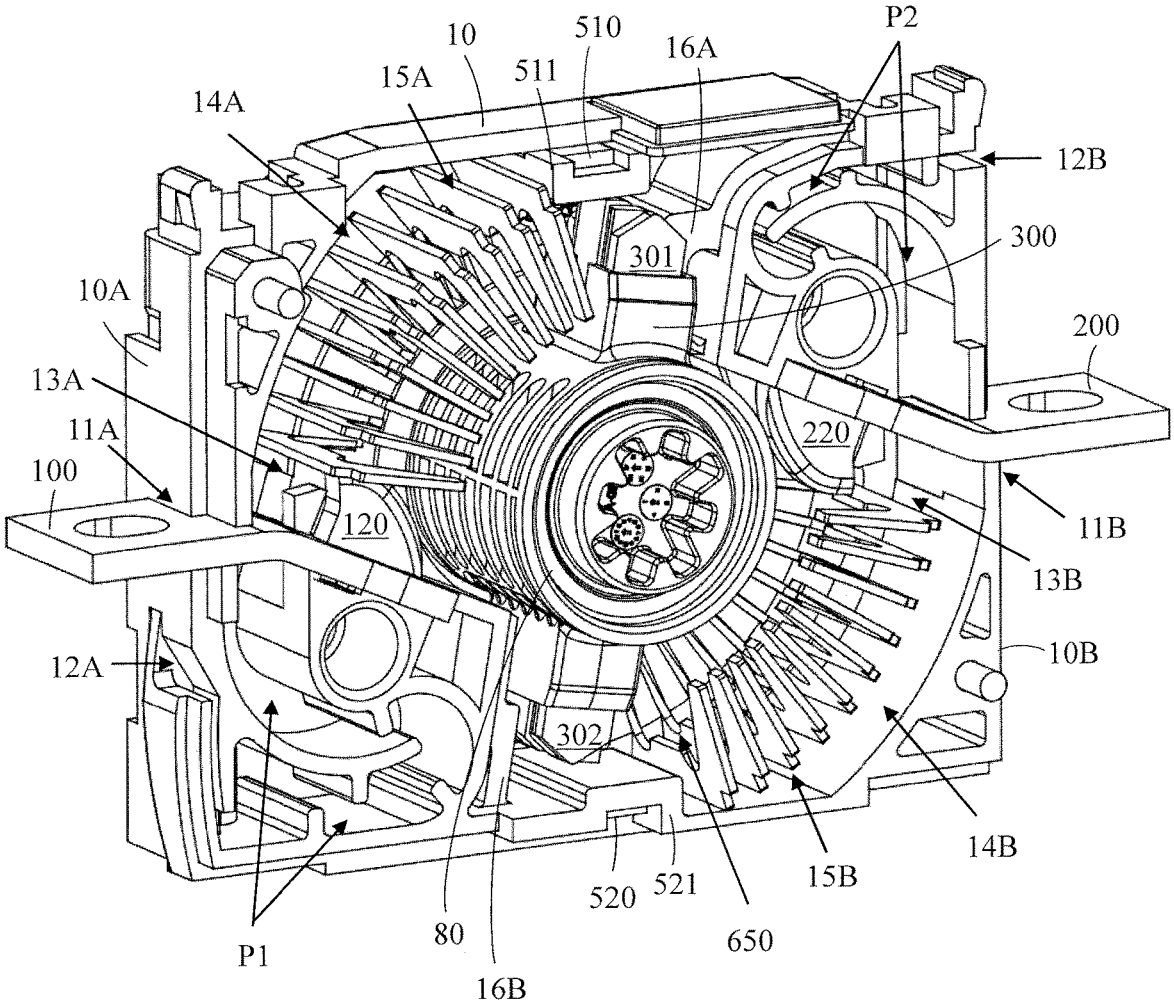
Figure 3:
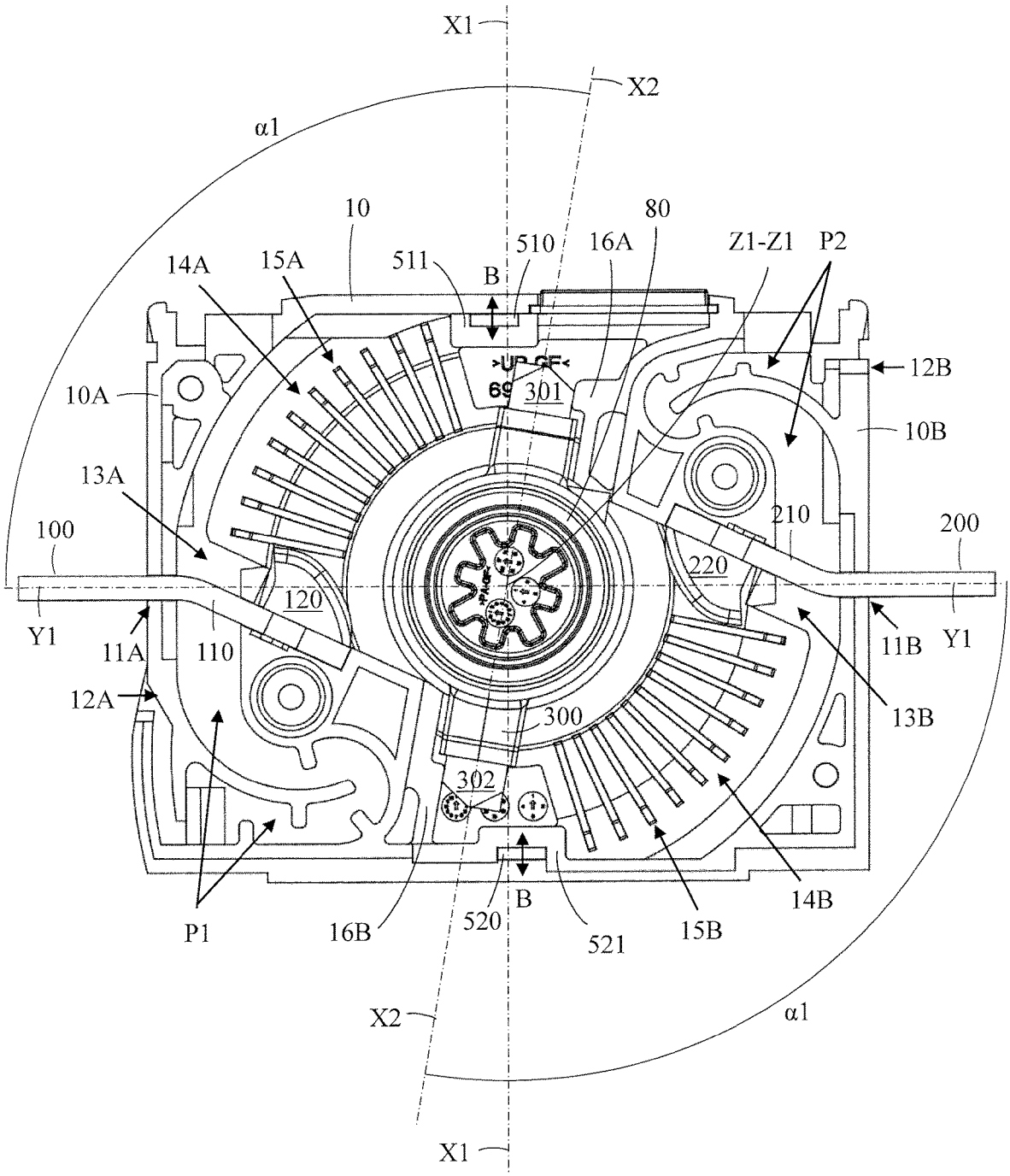
Figure 4:
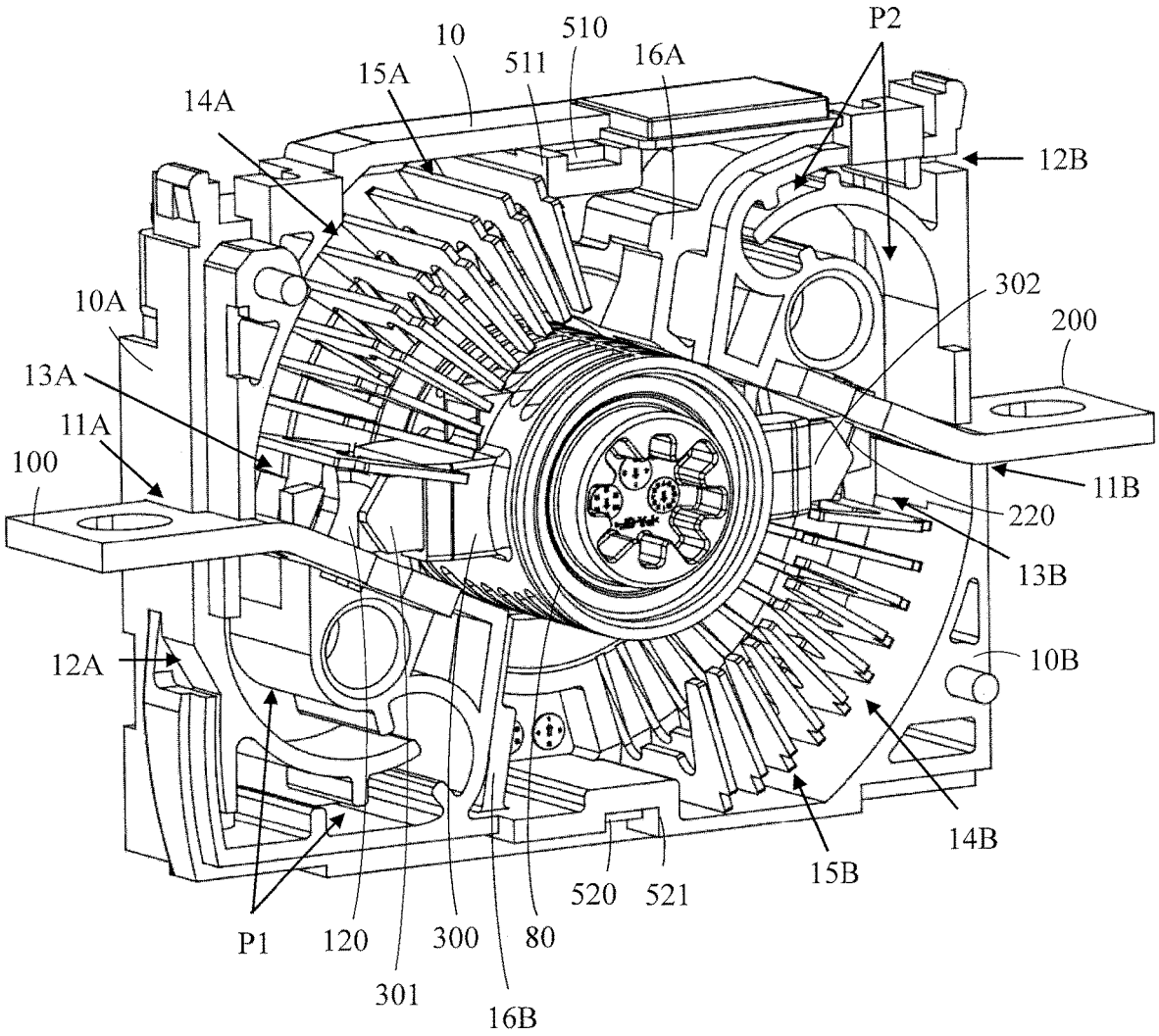
Figure 5:
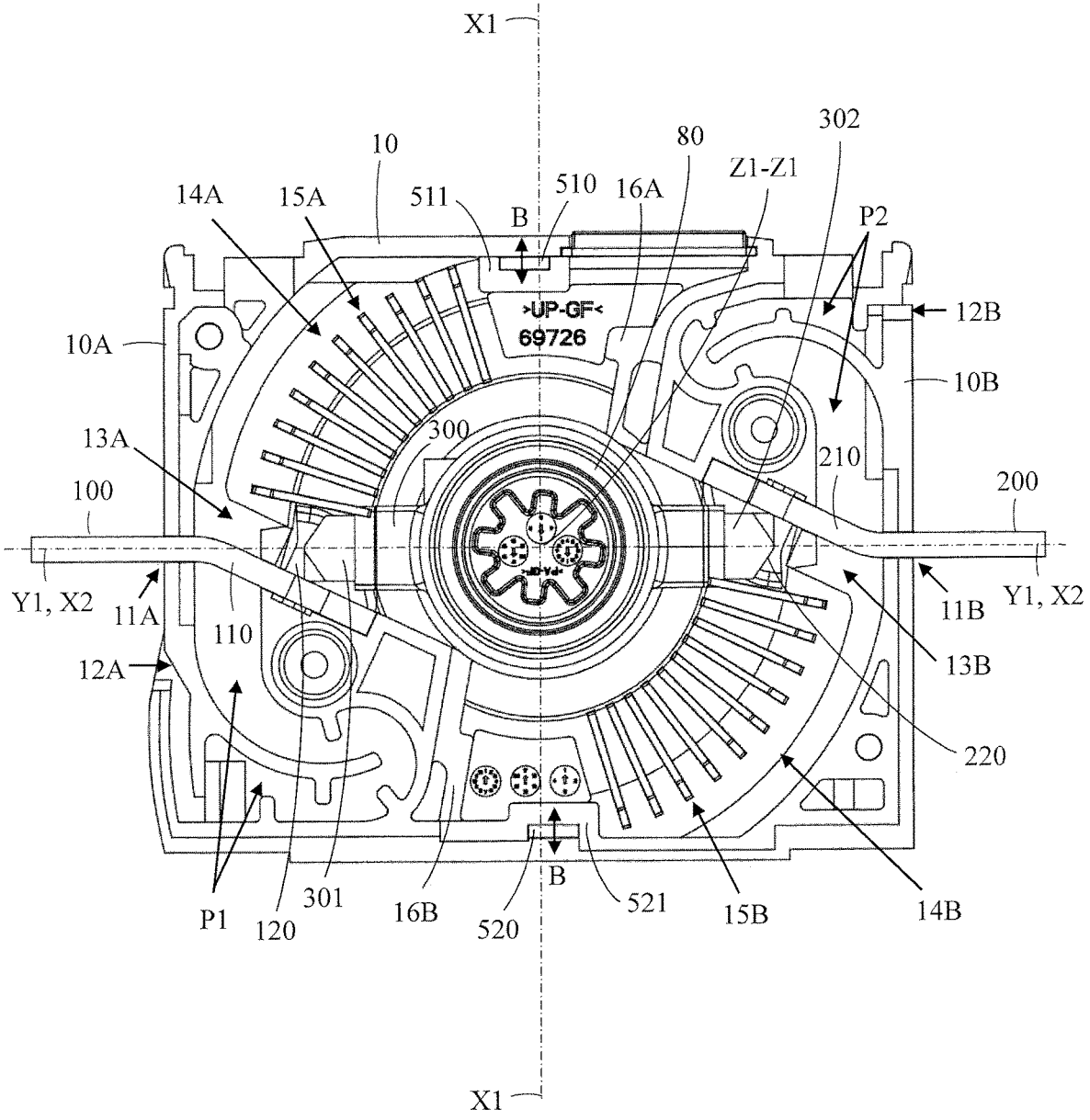
Figure 6:
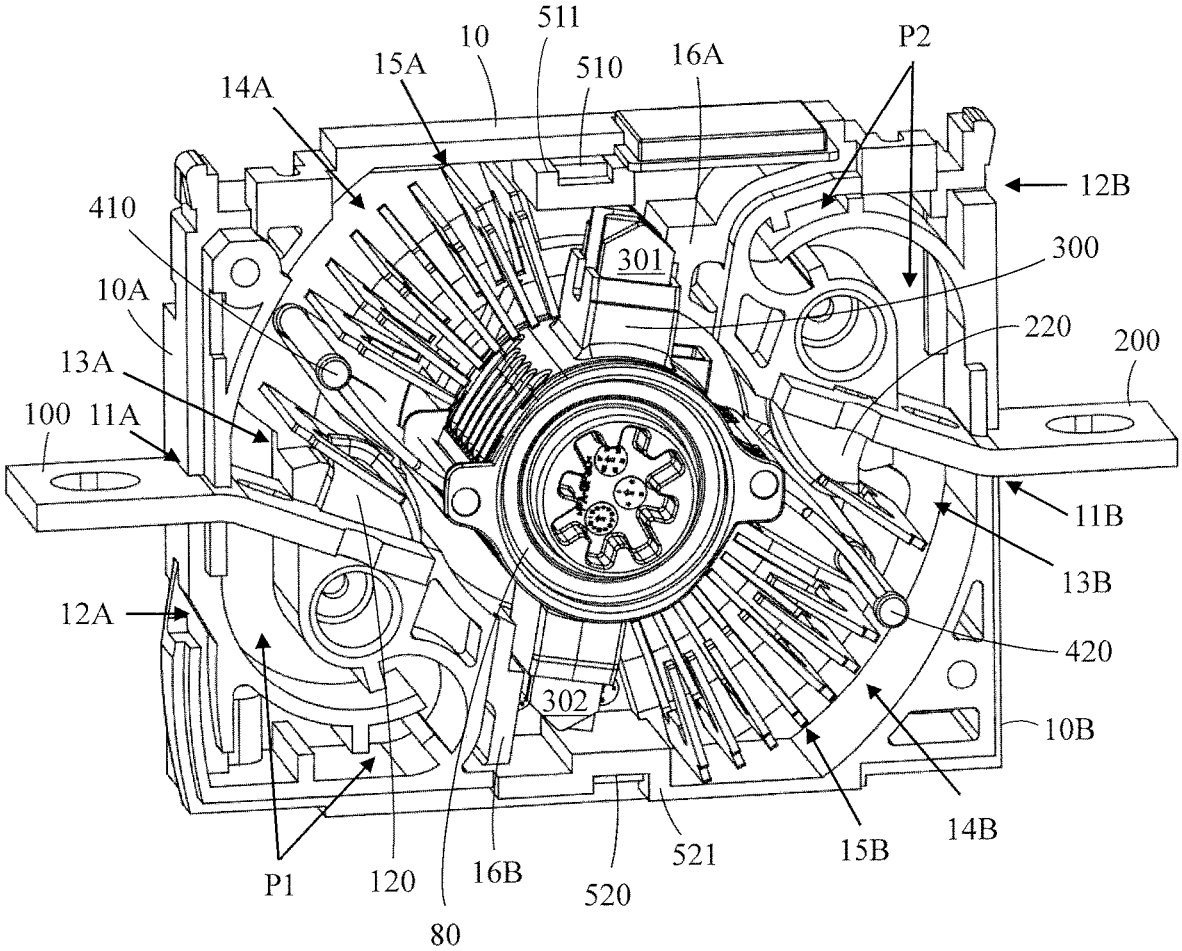
Figure 7:
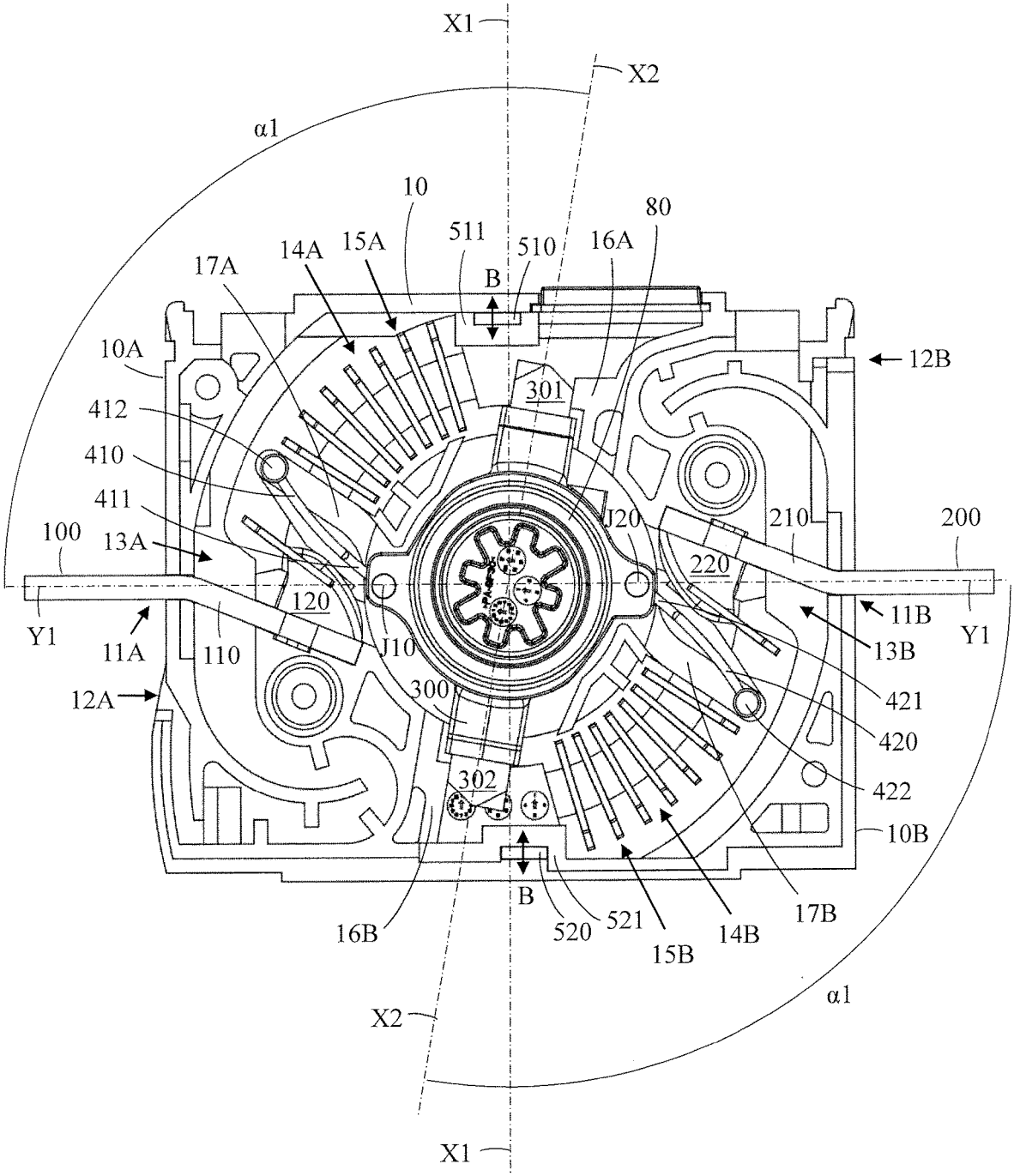
Figure 8:
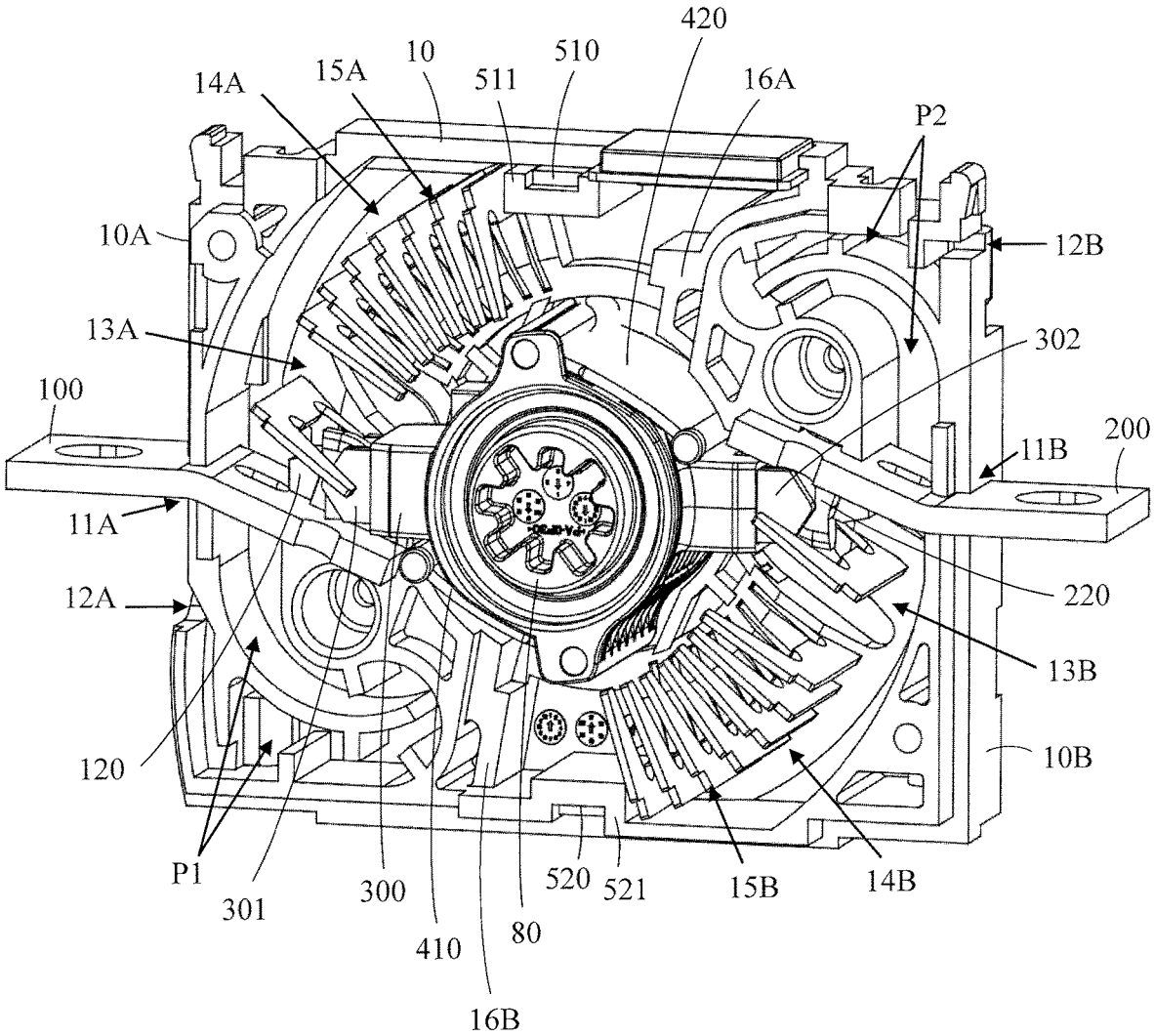
Figure 9:
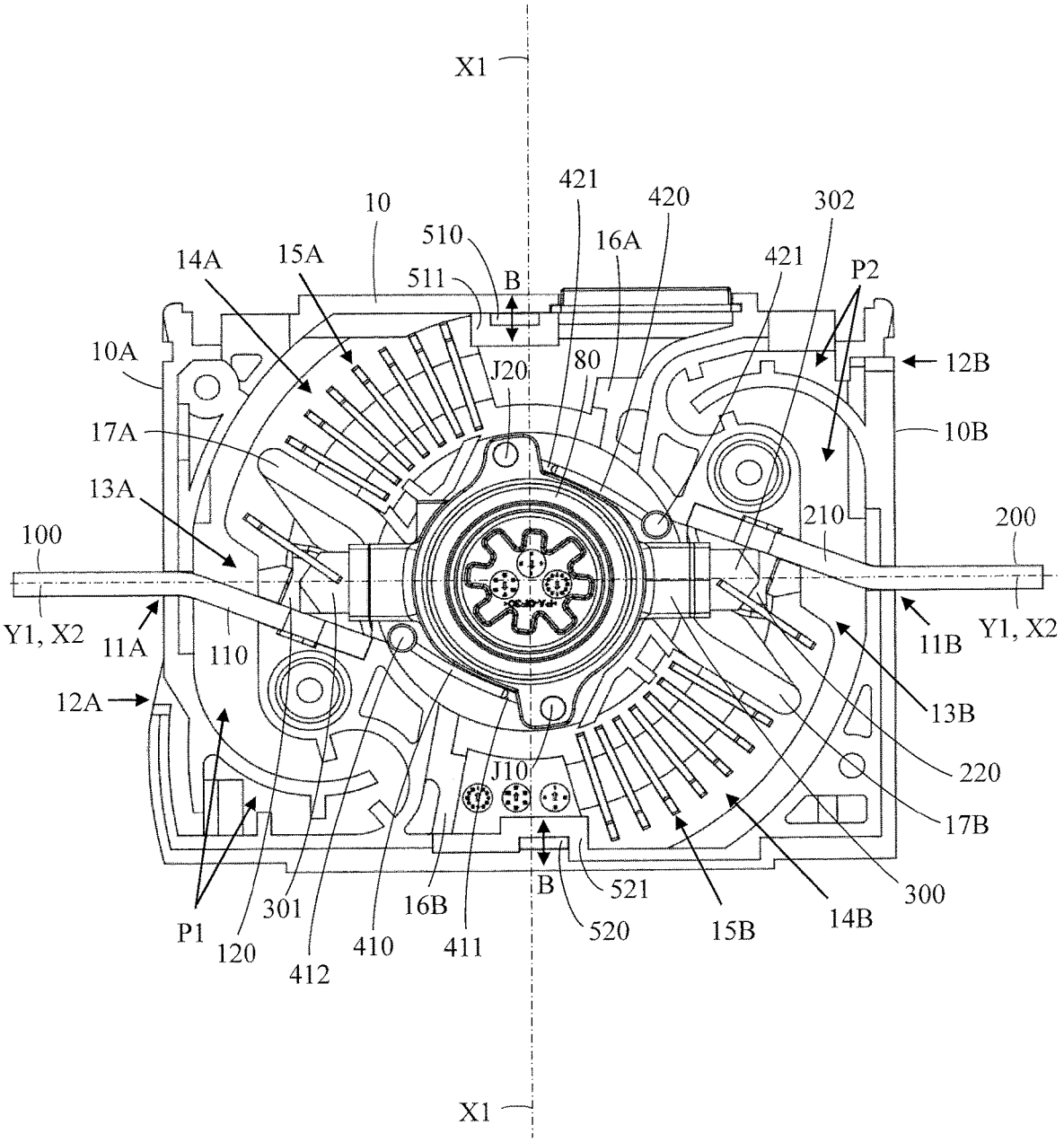
Figure 10:
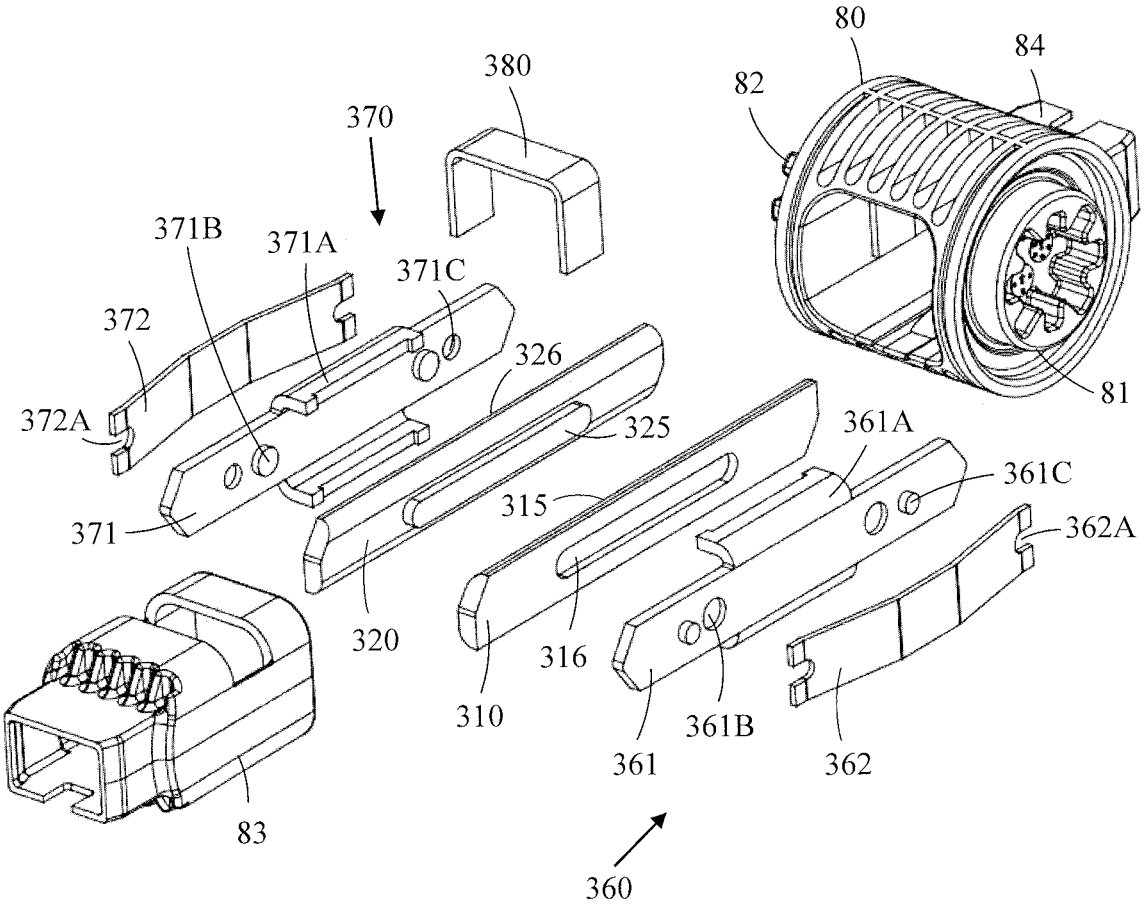
Figure 11:
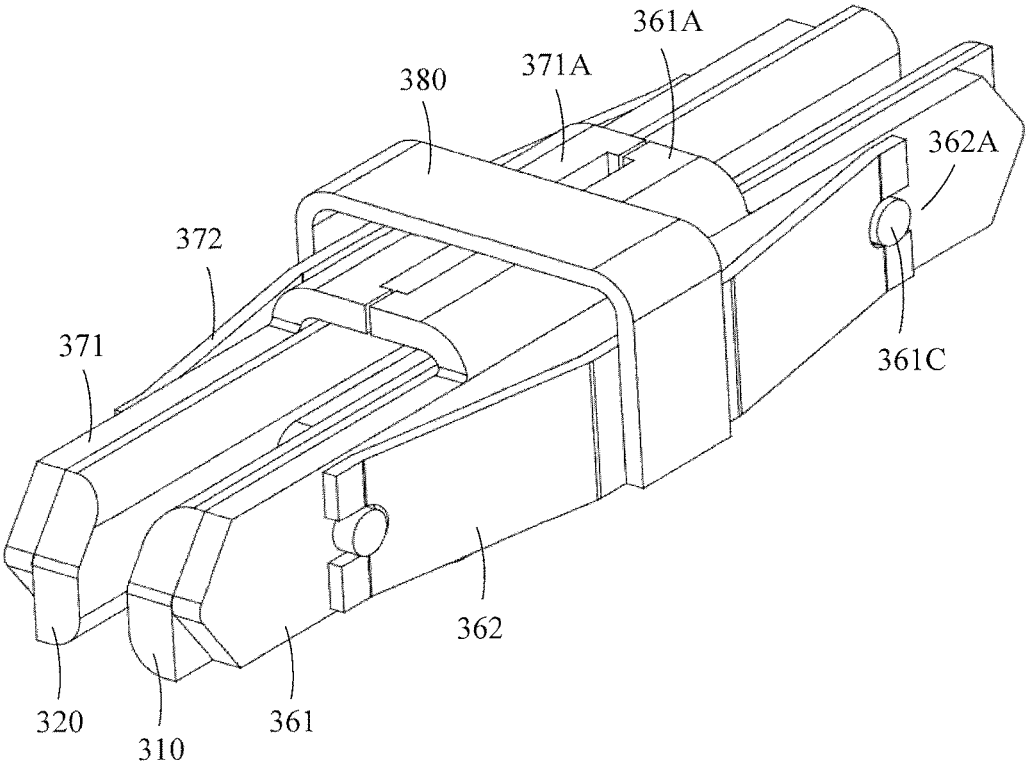
Figure 12:
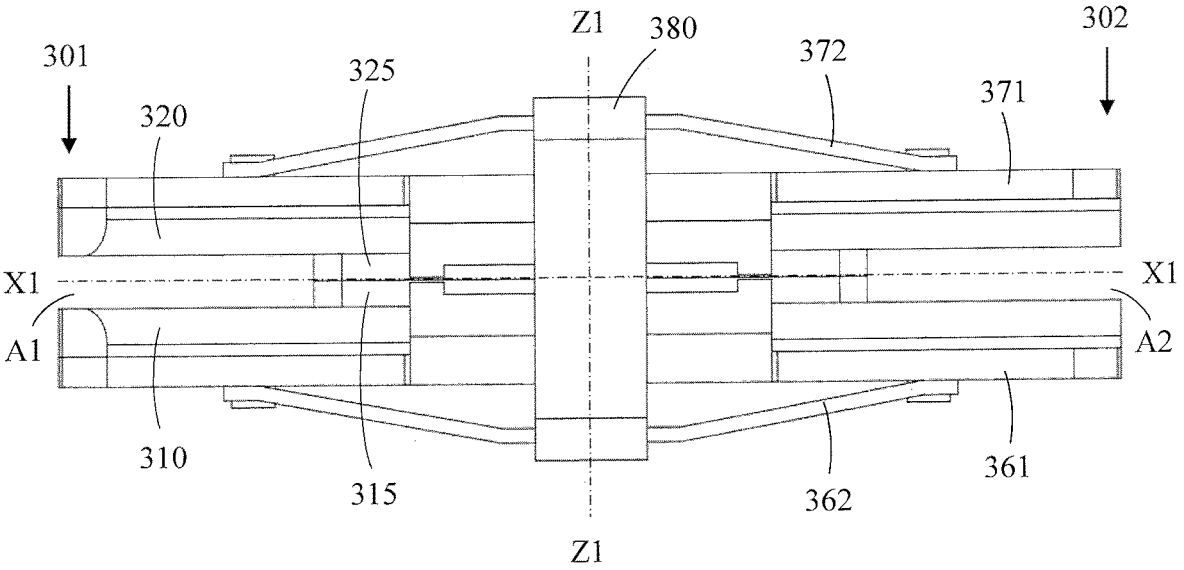
Figure 13:
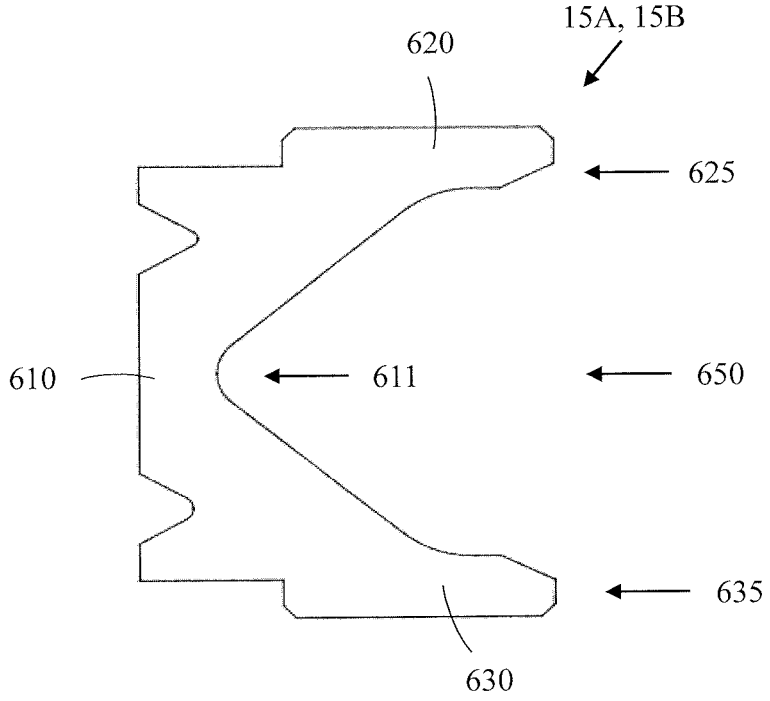
Figure 14:
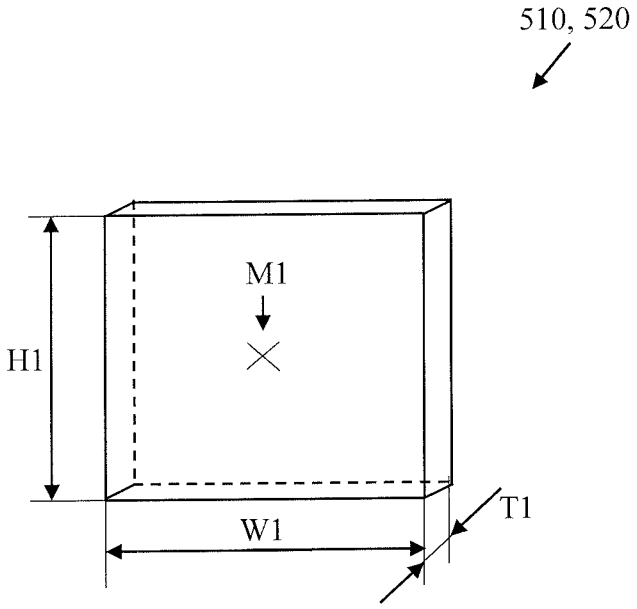
Figure 15:
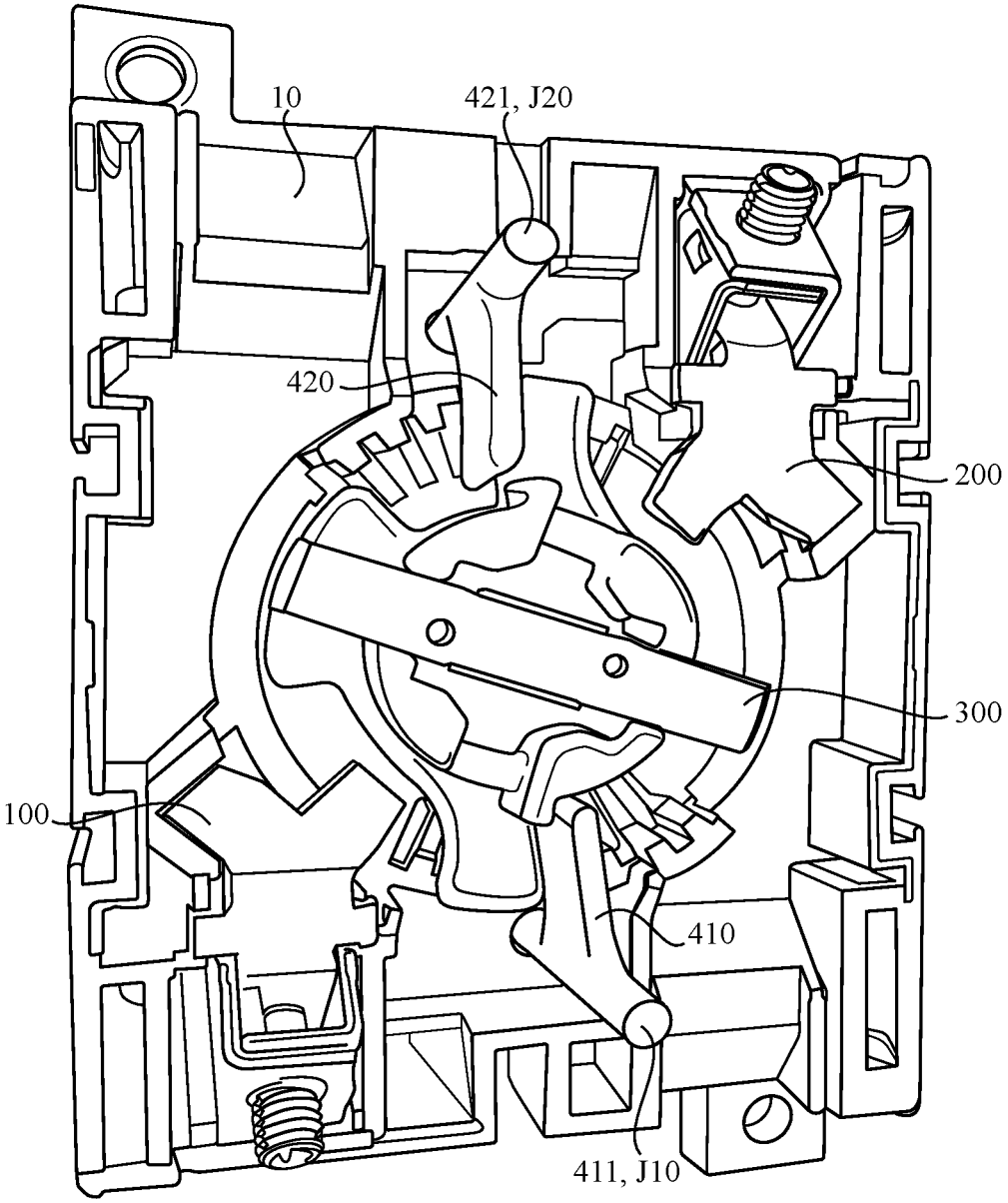
Figure 16:
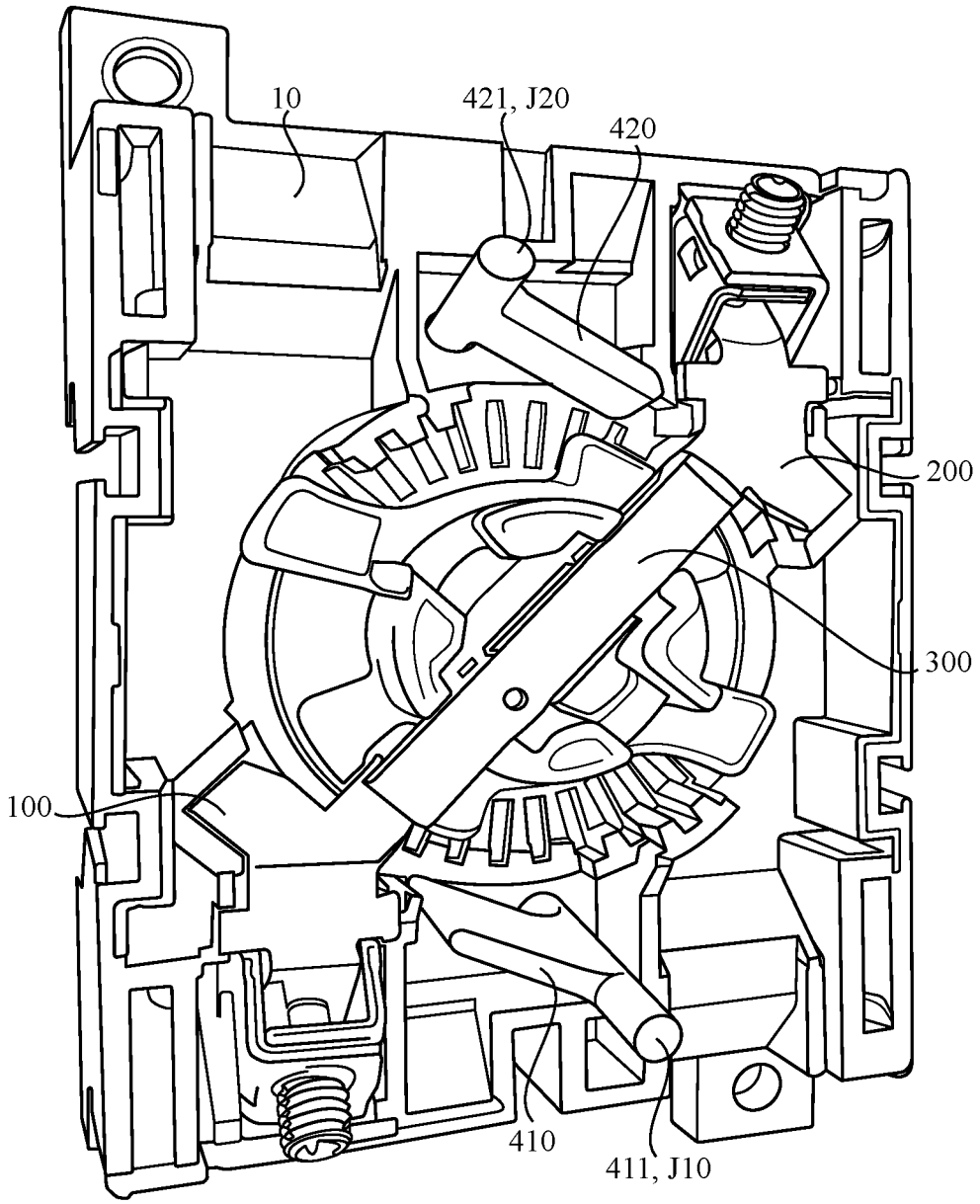

The invention will be described with reference to the accompanying drawings in which FIG. 1 shows a side view of an electrical switch, FIG. 2 shows an axonometric view of the electrical switch with one half of the housing removed, the electrical switch being shown in an open stage and provided with arc directing magnets, FIG. 3 shows a plane view of the electrical switch of FIG. 2, FIG. 4 shows an axonometric view of the electrical switch of FIG. 2 in a closed stage, FIG. 5 shows a plane view of the electrical switch of FIG. 4, FIG. 6 shows an axonometric view of the electrical switch with one half of the housing removed, the electrical switch being shown in an open stage and provided with arc directing magnets and arc directing shutter elements, FIG. 7 shows a plane view of FIG. 6, FIG. 8 shows an axonometric view of the electrical switch of FIG. 6 in an open stage, FIG. 9 shows a plan view of FIG. 8, FIG. 10 shows an exploded view of a movable contact and a roller of the electrical switch, FIG. 11 shows an axonometric view of a movable contact of the electrical switch, FIG. 12 shows a side view of the movable contact of FIG. 11, FIG. 13 shows a side view of an extinguishing plate, FIG. 14 shows a side view of a permanent magnet, FIG. 15 shows a plan view of an electrical switch according to another embodiment in an open stage, FIG. 16 shows a plan view of the electrical switch of FIG. 15 in a closed stage.

DETAILED DESCRIPTION

FIG. 1 shows an axonometric view of an electrical switch.

The electrical switch 600 comprises a housing 10 having a longitudinal direction Y-Y, a height direction X-X perpendicular to the longitudinal direction Y-Y, and a thickness direction Z-Z perpendicular to the longitudinal direction Y-Y and to the height direction X-X. The height direction X-X and the thickness direction Z-Z form transverse directions in relation to the longitudinal direction Y-Y of the housing 10.

The housing 10 consists of two halves 10L and 10U. The first half 10L of the housing 10 is placed against the second half 10U of the housing 10 so that a substantially closed space is formed within the two halves 10L, 10U. Each half 10L of the housing 10 comprises a side panel 10E, 10F and side walls 10A, 10B, 10C, 10D extending perpendicularly from the peripheral edges of the side panels 10E, 10F. The outer edges of the side walls 10A, 10B, 10C, 10D of the halves 10L, 10U of the housing 10 are placed against each other when the two halves 10L, 10U of the housing 10 are joined together. The outer edges of the side walls 10A, 10B, 100, 10D of the halves 10L, 10U of the housing 10 may comprise nested projections, whereby the joint between the two halves 10L, 10U of the housing 10 can be made to sustain the pressure caused by arcs within the housing 10.

A first side wall 10A and a second side wall 10B of the housing 10 are positioned spaced apart from each other in a longitudinal direction Y-Y of the housing 10. The first side wall 10A and the second side wall 10B are positioned opposite to each other. The first and the second side walls 10A, 10B extend in the height direction X-X and in the thickness direction Z-Z of the housing 10.

A third and a fourth side wall 10C, 10D connect the edges of the first side wall 10A and the second side wall 10B. The third side wall 10C and the fourth side wall 10D are positioned opposite to each other. The third and the fourth side wall 100, 10D extend in the longitudinal direction Y-Y and in the thickness direction Z-Z of the housing 10.

The side panels 10E, 10F are positioned spaced apart from each other in the thickness direction Z-Z of the housing 10. The side panels 10E, 10F connect the opposite edges of the side walls 10A, 10B, 100, 10D. The side panels 10E, 10F extend in the longitudinal direction Y-Y and in the height direction X-X of the housing 10.

Each half 10L, 10U of the housing 10 is also provided with mounting holes 21, 22, 23, 24 extending through the housing 10. The two halves 10L, 10U of the housing 10 may be secured to each other with mounting bolts and nuts extending through these mounting holes 21, 22, 23, 24. The first half 10L and the second half 10U of the housing 10 may further have adjustment means or adjustment surfaces for adjusting the two halves 10L, 10U in a correct position in relation to each other.

A first fixed contact 100 and a second fixed contact 200 is provided in the housing 10. Each of these two fixed contacts 100, 200 is connectable to an external electrical circuit with respect to the housing 10. The housing 10 is further provided with a movable contact 300 positioned wholly in the interior of the housing 10. The movable contact 300 may be mounted on a roller 80 having a second end protruding out from an opening 19 in the side plane 10F of the housing 10. The movable contact 300 is shown in the figures in which one half 10L, 10U of the housing 10 is removed.

The general form of the outline of housing 10 may correspond to a parallelepiped.

FIG. 2 shows an axonometric view of the electrical switch with one half of the housing removed, the electrical switch being shown in an open stage and provided with arc directing magnets and FIG. 3 shows a plane view of the electrical switch of FIG. 2.

The electrical switch may comprise a first fixed contact 100, a second fixed contact 200, a movable contact 300, a first arc extinguishing apparatus 14A, a second arc extinguishing apparatus 14B, a first arc directing permanent magnet 510, and a second arc directing permanent magnet 520.

The first fixed contact 100 may comprise a connection portion 110 and a contact portion 120 within the housing 10. The connection portion 110 of the first fixed contact 100 may be formed of substantially straight outer portion extending outside the housing 10 and a substantially straight inner portion extending within the housing 10. The outer portion and the inner portion may be inclined in relation to the each other. The inner portion of the connection portion 110 may be supported in a groove in the housing 10. There may be a first opening 11A in the first side wall 10A of the housing 10 for the connection portion 110 of first fixed contact 100. The connection portion 110 of the first fixed contact 100 can thus be connected to an external electrical circuit with respect to the housing 10. The contact portion 120 of the first fixed contact 100 acts as a plate-like contact surface. The contact may be formed from both opposing surfaces of the contact portion 120 of the first fixed contact 100.

The second fixed contact 200 may comprise in a similar way a connection portion 210 and a contact portion 220 within the housing 10. The connection portion 210 of the second fixed contact 200 may be formed of a substantially straight outer portion extending outside the housing 10 and a substantially straight inner portion extending within the housing 10. The outer portion and the inner portion may be inclined in relation to the each other. The inner portion of the connection portion 210 may be supported in a groove in the housing 10. There may be a second opening 11B in the second side wall 10B of the housing 10 for the connection portion 210 of second fixed contact 200. The connection portion 210 of the second fixed contact 200 can thus be connected to an external electrical circuit with respect to the housing 10. The contact portion 220 of the second fixed contact 200 acts as a plate-like contact surface. The contact may be formed from both opposing surfaces of the contact portion 220 of the second fixed contact 200.

The first fixed contact 100 and the second fixed contact 200 are positioned on opposite sides of the housing 10. The outer portions of the connection portions 110, 210 of the two fixed contacts 100, 200 may be parallel and extend essentially along the longitudinal direction Y-Y of the housing 10.

The movable contact 300 is movable from a closed position to an open position and vice a versa for establishing and disconnecting an electrical connection between the fixed contacts 100, 200. The movable contact 300 may comprise at least two longitudinal blades with opposite outer ends 301, 302. The movable contact 300 may be rotatable in respect of the housing 10 around a rotational axis Z1-Z1. The movable (rotatable) contact 300 is seen in an open position in FIGS. 2 and 3. The electrical switch is shown in an open stage in FIGS. 2 and 3, which means that the movable contact 300 has been turned clockwise so that the first end 301 of the movable contact 300 is at a distance from the first fixed contact 100 and second end 302 of the movable contact 300 is at a distance from the second fixed contact 200. There is thus no electrical connection between the first fixed contact 100 and the second fixed contact 200.

The rotational axis Z1, Z2 of the movable contact 300 may be located at a middle portion 350 of the longitudinal blades of the movable contact 300. The opposite outer ends 301, 302 of the blades of the movable contact 300 are thus free to make contact with the contact portion 120, 220 of the first and the second fixed contact 100, 200.

The rotational axis Z1, Z2 of the movable contact 300 may be located at the intersection of the transverse center line X1-X1 passing in the height direction X-X of the housing 10 and the longitudinal center line Y1-Y1 passing in the longitudinal direction Y-Y of the housing 10. The rotational axis Z1-Z1 of the movable contact 300 extends in FIG. 3 perpendicularly to the plane of the paper i.e. perpendicular to the longitudinal direction Y-Y and perpendicular to the height direction X-X of the housing 10. The movable contact 300 may be supported on a roller 80 positioned within the housing 10. The roller 80 may rotate around the rotational axis Z1, Z1 of the movable contact 300.

The first arc extinguishing apparatus 14A may be positioned after the first fixed contact 100 in the opening direction of the movable contact 300. The first arc extinguishing apparatus 14A may further be positioned adjacent to the first fixed contact 100. The first extinguishing apparatus 14A may be formed of extinguishing plates 15A extending in a radial direction and in the thickness direction Z-Z of the housing 10. The general form of the extinguishing plate 15A may be a lying letter U. A slit 650 may be formed within the extinguishing plate 15A between side portions of the extinguishing plate 15A. The slit 650 may form a passage for the first end 301 of the blades of the movable contact 300. The first end 301 of the blades in the movable contact 300 may thus pass through the slit 650 when the movable contact 300 is rotated from the closed state to the open state and vice a versa. The slit 650 may extend substantially in the radial direction relative to the rotational axis Z1-Z1 of the movable contact 300.

The second arc extinguishing apparatus 14B may be positioned after the second fixed contact 200 in the opening direction of the movable contact 300. The second arc extinguishing apparatus 14B may further be positioned adjacent to the second fixed contact 200. The second arc extinguishing apparatus 14B may be identical to the first extinguishing apparatus 14A. The second end 302 of the blades in the movable contact 300 may thus pass through the slit 650 in the extinguishing plates 15B in the second arc extinguishing apparatus 14B when the movable contact 300 is rotated from the closed state to the open state and vice a versa.

The structure of the extinguishing plates 15A is explained more in detail in connection with FIG. 13.

The arc is an electrical discharge which is generated when the voltage between two contacts exceed the dielectric strength of the material (air) between the contacts. The resistance between the contacts increases when the contacts open and the contact pressure reduces resulting in an arc between the contacts. The contacts will thus heat up and a portion of the contact material may melt and eventually evaporate. The breakthrough occurs when the metal vapor and air molecules between the contacts break down into atoms and further into ions increasing the electrical conductivity of the gas. The arc may be extinguished by increasing the arc voltage, i.e. by transferring energy away from the arc. The energy of the arc may be reduced by prolonging, cooling or braking the arc with perpendicular extinguishing plates of metal.

The first arc directing permanent magnet 510 may be positioned after the second arc extinguishing apparatus 14B in the opening direction of the movable contact 300. The first arc directing permanent magnet 510 may further be positioned adjacent to the second arc extinguishing apparatus 14B. The first arc directing permanent magnet 510 may be positioned outside the path of the first outer end 301 of the movable contact 300 when the movable contact 300 moves from the closed position to the open position and vice a versa. The first arc directing permanent magnet 510 may be positioned in a first compartment 511 formed into the housing 10. The first compartment 511 may form a closed space for the first arc directing permanent magnet 510 when the two halves 10L, 10U of the housing 10 are mounted together. One of the halves 10L, 10U of the housing 10 may comprise a first recess into which the first permanent magnet 510 may be positioned. The opposite half 10L, 10U of the housing 10 may comprise a protrusion extending into the recess securing the first permanent magnet 510 into the recess and closing the recess. The first compartment 511 may be formed as an integral part of the housing 10 or as a separate part to be installed into the housing 10. The first arc extinguishing permanent magnet 510 is a separate entity of its own.

The second arc directing permanent magnet 520 may be positioned after the second arc extinguishing apparatus 14B in the opening direction of the movable contact 300. The second arc directing permanent magnet 520 may further be positioned adjacent to the second extinguishing apparatus 14B. The second arc directing permanent magnet 520 may be positioned outside the path of the second outer end 302 of the movable contact 300 when the movable contact 300 moves from the closed position to the open position and vice a versa. The second arc directing permanent magnet 520 may be positioned in a second compartment 521 formed into the housing 10. The second compartment 521 may form a closed space for the second arc directing permanent magnet 520 when the two halves 10L, 10U of the housing 10 are mounted together. One of the halves 10L, 10U of the housing 10 may comprise a second recess into which the second permanent magnet 520 may be positioned. The opposite half 10L, 10U of the housing 10 may comprise a protrusion extending into the recess securing the second permanent magnet 520 into the recess and closing the recess. The second compartment 521 may be formed as an integral part of the housing 10 or as a separate part to be installed into the housing 10. The second arc extinguishing permanent magnet 520 is a separate entity of its own.

The housing 10 may comprise a first chamber 13A and a second chamber 13B. The first chamber 13A extends within the housing 10 on both sides of the first fixed contact 100 and the second chamber 13B extends within the housing 10 on both sides of the second fixed contact 200. The contact portion 120 of the first fixed contact 100 and the first arc extinguishing apparatus 14A may be positioned in the first chamber 13A. The contact portion 220 of the second fixed contact 200 and the second arc extinguishing apparatus 14B may be positioned in the second chamber 13B. The first end 301 of the movable contact 300 moves within the first chamber 13A and the second end 302 of the movable contact 300 moves within the second chamber 13B when the electrical switch is switched on and off.

The first chamber 13A extends below and above the first fixed contact 100 downwards in the FIGS. 2 and 3 forming a first exhaust gas passage P1 for exhaust gases to escape through said first exhaust gas passage P1 and further through a first exhaust opening 12A in the housing 10. The first exhaust gas passage P1 has a mussel shaped form extending the path of the exhaust gases within the housing 10 before the exhaust gases are discharged through the first exhaust opening 12A from the housing 10. An arc is generated between the first fixed contact 100 and the first end 301 of the movable contact 300 when the contact between the first end 301 of the movable contact 300 and the first fixed contact 100 is broken and the first end 301 of the movable contact 300 is turned away from the first fixed contact 100 through the first extinguishing apparatus 14A. The arc produces hot gases within the first chamber 13A. The function of the first extinguishing apparatus 14A is to cut off the arc when the first end 301 of the movable contact 300 passes through the first arc extinguishing apparatus 14A.

The second chamber 13B extends in a corresponding way below and above the second fixed contact 200 upwards in the FIGS. 2 and 3 forming a second exhaust gas passage P2 for exhaust gases to escape through said second exhaust gas passage P2 and further through a second exhaust opening 12B in the housing 10. The second exhaust gas passage P2 has a mussel shaped form extending the path of the exhaust gases within the housing 10 before the exhaust gases are discharged through the second exhaust opening 12B from the housing 10. An arc is generated between the second fixed contact 200 and the second end 302 of the movable contact 300 when the contact between the second end 302 of the movable contact 300 and the second fixed contact 200 is broken and the second end 302 of the movable contact 300 is turned away from the second fixed contact 200 through the second extinguishing apparatus 14B. The arc produces hot gases within the second chamber 13B. The function of the second extinguishing apparatus 14B is to cut off the arc when the second end 302 of the movable contact 300 passes through the second arc extinguishing apparatus 14B.

A longer exhaust gas passage P1, P2 for the combustion gases within the housing 10 will help to cool the combustion gases and to reduce the kinetic energy of the combustion gases before the combustion gases are expelled from the exhaust openings 12A, 12B in the housing 10.

FIGS. 2 and 3 show the electrical switch in an open state. The movable contact 300 has been rotated in a clockwise direction to the open position from the closed position in which the longitudinal center line X2-X2 of the movable contact 300 coincides with the longitudinal center line Y1-Y1 of the housing 10. The longitudinal center line X2-X2 of the movable contact 300 forms in the open state an angle $\alpha 1$ with the longitudinal center line Y1-Y1 of the housing 10. The opening angle $\alpha 1$ of the movable contact 300 is thus the angle between the longitudinal center line X2-X2 of the movable contact 300 and the longitudinal center line Y1-Y1 of the housing 10 when the movable contact 300 is in the open position. Both longitudinal center lines X2-X2 and Y1-Y1 pass through the rotational axis Z1-Z1 of the movable contact 300. The magnitude of the opening angle $\alpha 1$ of the movable contact 300 is in this embodiment substantially 100 degrees.

The use of a fairly big opening angle $\alpha 1$ is advantageous in the invention. A fairly big opening angle $\alpha 1$ makes it possible to fit more extinguishing plates 15A, 15B into the extinguishing apparatus 14A, 14B. An increase in extinguishing plates 15A, 15B will prolong the path of the arc. The result is an increased breaking capacity of the electrical switch. There is, however, no need to have an opening angle $\alpha 1$ of substantially 100 degrees in the invention. The invention may be used also in electrical switches provided with a smaller opening angle $\alpha 1$.

The first end 301 of the movable contact 300 has passed from contact with the first fixed contact 100 through the first extinguishing apparatus 14A to an end position in which the first end 301 of the movable contact 300 rests against a first stop element 16A in the housing 10. The second end 302 of the movable contact 300 has passed from contact with the second fixed contact 200 through the second extinguishing apparatus 14B to an end position in which the second end 302 of the movable contact 300 rests against a second stop element 16B in the housing 10. The ends 301, 302 of the movable contact 300 rest against respective stop elements 16A, 16B in this open stage shown in FIGS. 2 and 3.

FIG. 4 shows an axonometric view of the electrical switch of FIG. 2 in a closed stage and FIG. 5 shows a plane view of the electrical switch of FIG. 4.

The movable contact 300 has been rotated in a counterclockwise direction from the open stage shown in FIGS. 2 and 3 to the closed stage. The longitudinal center line X2-X2 of the movable contact 300 coincides with the longitudinal center line Y1-Y1 of the housing 10 when the electrical switch is in the closed state. The contact portion 120 of the first fixed contact 100 is received between a first end 301 of the blades of the movable contact 300 and the contact portion 220 of the second fixed contact 200 is received between a second end 302 of the blades of the movable contact 300. The first fixed contact 100 is thus electrically connected to the second fixed contact 200 via the blades in the movable contact 300.

FIG. 6 shows an axonometric view of the electrical switch with one half of the housing removed, the electrical switch being shown in an open stage and provided with arc directing magnets and arc directing shutter elements and FIG. 7 shows a plane view of FIG. 6.

The electrical switch of FIGS. 6 and 7 correspond to the electrical switch of FIGS. 2 and 3 except for the shutter elements 410, 420.

The electrical switch comprises two shutter elements 410, 420.

The shutter elements 410, 420 may be movable in synchronism with the rotatable contact 300 between an extended position and a contracted position. The shutter element 410, 420 is positioned in the extended position between the fixed contact 100, 200 and the extinguishing apparatus 14A, 14B when the rotatable contact 300 is in the open position. The shutter element 410, 420 is positioned in the contracted position outside the patch of the movable contact 300 allowing the movable contact 300 to turn from the open position to the closed position. The shutter element 410, 420 may, in the contracted position, be positioned on the side of the rotatable contact 300.

The movement of the shutter elements 410, 420 in synchronism with the rotatable contact 300 may be realized by connecting the shutter elements 410, 420 directly to the rotatable contact 300 or by connecting the shutter elements 410, 420 via a transmission to the rotatable contact 300. The transmission can be any kind of transmission e.g. based on cog wheels or based on rods or based on a combination of these.

Two shutter elements 410, 420 may be connected to the movable contact 300. The first shutter element 410 may operate in connection with the first fixed contact 100 and the first extinguishing apparatus 14A. The second shutter element 420 may operate in connection with the second fixed contact 200 and the second extinguishing apparatus 14B.

An inner end 411, 421 of each of the shutter elements 410, 420 may be connected with an articulated joint J10, J20 to the roller 80 of the movable contact 300. An outer end 412, 422 of each shutter element 410, 420 may be formed as a guide pin. Each of the halves 10L, 10U in the housing 10 may comprise a guide groove 17A, 17B for the guide pin positioned on the outer end 412, 422 of the shutter element 410, 420. The guide pin in each outer end 412, 422 of each shutter element 410, 420 will thus follow the path of the guide groove 17A, 17B when the movable contact 300 is rotated. The articulated joint J10, J20 in the inner end 411, 421 of each shutter element 410, 420 allows turning of the shutter element 410, 420 so that the outer end 412, 422 of the shutter element 410, 420 may travel along the guide groove 17A, 17B when the roller 80 and thereby also the movable contact 300 is rotated.

The shutter elements 410, 420 are in an extended position when the electrical switch is in an open state as shown in FIGS. 6 and 7. The shutter elements 410, 420 extend in this extended position between the respective fixed contact 100, 200 and the respective extinguishing apparatus 14A, 14B. The shutter elements 410, 420 extend from the roller 80 of the movable contact 300 to substantially an outer perimeter of the extinguishing apparatus 14A, 14B. One extinguishing plate 15A, 15B may still be positioned between the shutter element 410, 420 and the fixed contact 100, 200 as seen in the FIGS. 6 and 7. This first extinguishing plate 15A, 15B may extend partly on the contact portion 120, 220 of the fixed contact 100, 200. The contact portion 120, 220 of the fixed contact 100, 200 may thus be positioned within the slit in the extinguishing plate 15A, 15B. The rest of the extinguishing plates 15A, 15B in the extinguishing apparatus 14A, 14B may be positioned between the shutter element 410, 420 and the end position of the outer end 301, 302 of the movable contact 300.

Each shutter element 410, 420 may be formed as a slightly curved plate as shown in the figures. The plate may be solid. The curved form is advantageous when the shutter element 410, 420 is in a contacted position on the side of the roller 80 of the movable contact 300. Each shutter element 410, 420 may extend along the whole thickness of the housing 10 in the thickness direction Z-Z of the housing 10. Another possibility is that the portion of the shutter element 410, 420 between the inner ends 411, 421 and the outer ends 412, 422 of the shutter element 410, 420 does not extend over the whole thickness of the housing 10.

Each shutter element 410, 420 may be made of a non-conducting material e.g. of plastic. The outer end 412, 422 of the shutter element 410, 420 may be provided with an electrically conducting element e.g. a metal screw within the non-conducting material, but this is by no means necessary. The function of the shutter element 410, 420 is to direct the arc to the extinguishing apparatus 14A, 14B. The shutter element 410, 420 prevents the arc from passing directly from the contact portion 120, 220 of the fixed contact 100, 200 to the outer end 301, 302 of the movable contact 300 radially below the extinguishing apparatus 14A, 14B.

FIG. 8 shows an axonometric view of the electrical switch of FIG. 6 in an open stage and FIG. 9 shows a plan view of FIG. 8.

Each of the shutter elements 410, 420 are in this open stage of the electrical switch positioned at the side of the roller 80 of the movable contact 300. The shutter elements 410, 420 are thus positioned outside the patch of the movable contact 300 allowing the movable contact 300 to turn from the open position to the closed position.

Each guide groove 17A, 17B comprises a first circumferential path followed by a second substantially radial path. The outer end 412, 422 of each shutter element 410, 420 is positioned in the circumferential path when the electrical switch is in the open stage. The outer end 412, 422 of each shutter element 410, 420 is pushed forward first in the circumferential path of the guide groove 17A, 17B and then in the radial path of the guide groove 17A, 17B when the movable contact 300 is rotated in the clockwise direction.

The outer end 412, 422 of the shutter element 410, 420 enters into the radial path of the guide groove 17A, 17B when the outer end 301, 302 of the movable contact 300 has moved to a distance from the respective fixed contact 100, 200 so that the outer end 301, 302 of the movable contact 300 is within the extinguishing apparatus 14A, 14B. The arc burning between the contact portion 120, 220 of the fixed contact 100, 200 and the outer end 301, 302 of the movable contact 300 is pushed radially outwards as the outer end 412, 422 of the shutter element 410, 420 passes radially outwards in the guide groove 17A, 17B. The arc is thus forced into the extinguishing apparatus 14A, 14B.

FIG. 10 shows an exploded view of a movable contact and a roller of the electrical switch.

The movable contact 300 comprises, in this embodiment, a single blade pair formed of two longitudinal blades 310, 320. Each blade 310, 320 may be formed as one single piece. Each blade 310, 320 may be formed of a substantially straight solid bar having a length, a width and a thickness. The bar may have a substantially rectangular cross section. The length of the blade 310, 320 may correspond to the length of the movable contact 300. A middle portion of each of the blades 310, 320 may comprise a protrusion 315, 325, which may be made by punching the bar from the opposite side.

The protruded middle portions 315, 325 may seat against each other when the blades 310, 320 are connected to each other. The blades 310, 320 in the pair of blades may thus become supported at each other through the protruded middle portions 315, 325. The width of the protruded middle portion 315, 325 may be only a portion of the width of the blade 310, 320.

The blades 310, 320 in the pair of blades may be flexible attached to each other with a spring structure 360, 370. The spring structure 360, 370 may comprise a spring guide 361, 371, a spring 362, 372 and a tensing bar 380.

The spring guide 361, 371 may be formed of a longitudinal plate extending in the longitudinal direction of the blade 310, 320 and positioned against the outer surface of the blade 310, 320. A middle portion of the plate may comprise arms 361A, 371A extending in a transverse direction over the edges of the blade 310, 320. The inner surface of the plate may comprise outwardly extending pins 361B, 371B that may be seated in a groove 316, 326 in the outer surface of the blade 310, 320. The groove 316, 326 in the outer surface of the blade 310, 320 may be in the same position as the protrusion 315, 325 in the inner surface of the blade 310, 320. The groove 316, 326 and the protrusion 315, 325 may be made in one step by punching the blade 310, 320 from the outer surface. The pins 361B, 371B may lock the spring guide 361, 371 to the blade 310, 320 in the transverse direction of the blade 310, 320 and may allow a small movement in the longitudinal direction of the blade 310, 320.

The spring 362, 372 may be formed of a spring 362, 372 extending in the longitudinal direction of the blade 310, 320 and being adapted to the outer surface of the blade 310, 320. Opposite ends of the spring 362, 372 may comprise a groove 362A, 372A having the form of a half circle and being seated against a pin 361C, 371C protruding from the outer surface of the spring guide 361, 371. The tensing bar 380 may be seated against the outer surface of the middle portion of the spring 362, 372.

The pins 361B, 371B protruding from the inner surface of the spring guide 361, 371 and the pins 361C, 371C protruding from the outer surface of the spring guide 361, 371 may be made by punching from the opposite side of the spring guide 361, 371.

The tensing bar 380 may be formed of a U-formed piece, which may compress the blades 310, 320 together at a desired force. The pressing force of the tensing bar 380 may be adjusted by changing the dimensions of the tensing bar 380. The tensing bar 380 may extend over one edge of the blades 310, 320. The cross section of the tensing bar 380 may be rectangular. The tensing bar 380 may extend in a transverse direction in view of the longitudinal direction of the blade pair 310, 320. The tensing bar 380 may be positioned substantially at a longitudinal middle point of the blades 310, 320.

The figure shows also the protrusions 83, 84 protruding from the roller 80. One of the protrusions 83 may be formed of a separate part, which may be pushed with the blade pair 310, 320 into the roller 80. This removable protrusion 83 may be attached to the roller 80 with quick coupling means.

The magnetic field caused by a current passing in the same direction in each blade 310, 320 in the movable contact 300 will produce a force between the blades 310, 320. The force will pull the blades 310, 320 towards each other. The spring guides 361, 371 will restrict the leakage of the magnetic field from the blades 310, 320, whereby a strong magnetic field is maintained between the blades 310, 320 especially in a short circuit situation with strong currents. The spring guides 361, 371 are of metal, preferably of steel.

The blades 310, 320 in the pair of blades in the movable contact 300 may be supported on the cylinder-like roller 80 so that opposing ends 301, 302 of the movable contact 300, which also constitute the opposing ends of the blade pair 310, 320, protrude from the roller 80. The opposite ends 301, 302 of the blades 310, 320 protrude out from the radially outwardly extending side protrusions 83, 84 of the roller 80. Each of the two side protrusions 83, 84 of the roller 80 may have the form of a tube with a rectangular cross section forming a guide for the blades 310, 320 in the movable contact 300.

The roller 80 that is positioned within the housing 10 may be rotatable in respect of the housing 10. The roller 80 may comprise an end portion 81, 82 at each longitudinal opposite end of the roller 80. Each end portion 81, 82 of the roller 80 may be supported in a circular opening 19 formed in each side panel 10E, 10F of the housing 10. The end portions 81, 82 of the roller 80 rotate against the circumference of the circular opening 19 in each side panel 10E, 10F of the housing 10. The movable contact 300 may thus rotate with the roller 80 around the rotational axis Z1-Z1 directed in the thickness direction Z-Z of the housing 10.

FIG. 11 shows an axonometric view of a movable contact of the electrical switch and FIG. 12 shows a side view of the movable contact of FIG. 11.

The roller 80 is not shown in the figures. The blades 310, 320 in the movable contact 300 may comprise two opposite outer ends 301, 302. A first contact gap A1 may be formed between the two opposite blades 310, 320 at the first end 301 of the blades 301, 302 and a second contact gap A2 may be formed between the two opposite blades 310, 320 at the second end 302 of the blades 301, 302. The outer ends 301, 302 of the movable contact 300 may form contact portions of the movable contact 300.

The flexible attachment of the blades 310, 320 to each other is needed so that the contact portion 120, 220 of the respective fixed contact 100, 200 may penetrate into the contact gap A1, A2 between the ends 301, 302 of the blades 410, 420 when the electrical switch is closed. The spring structures 360, 370 will thus press the blades 310, 320 against the respective surface in the contact portion 120, 220 of the respective fixed contact 100, 200 when the switch is closed.

The blades 310, 320 may, in a non-deflected situation, rotate in parallel planes. The figure shows a central rotation plane X1-X1 between the blades 310, 320.

The amount of blade pairs 310, 320 in the movable contact 300 may be increased in a situation where a greater current-carrying capacity through the electrical switch 700 is required. The blade pairs 310, 320 may be superimposed on each other in the roller 80. The blade pairs 310, 320 will then act synchronously with respect to each other, i.e., the superimposed blade pairs 310, 320 are parallel.

The rotational axis Z1-Z1 of the movable contact 300 may be positioned in a middle portion 350 of the movable contact 300.

The path of the outer ends 301, 302 of the movable contact 300 follow a circumference of a circle having the middle point in the rotational axis Z1-Z1 of the movable contact 300 when the movable contact 300 is rotated between the closed position and the open position and vice a versa.

FIG. 13 shows a side view of an extinguishing plate.

The extinguishing plate 15A, 15B may have a bottom portion 610 extending in the thickness direction Z1-Z1 of the casing 10 and two side portions 620, 630 extending perpendicularly outwards from each end of the bottom portion 610. The side portions 620, 630 may be arranged substantially parallel to each other. The general form of the extinguishing plate 15A, 15B is thus a lying letter U. A slit 650 is thus formed within the extinguishing plate 15A, 15B between the side portions 620, 630 of the extinguishing plate 15A. The slit 650 extends in a radial direction from outer edges 625, 635 of the branches of the letter U to the bottom portion 610 of the extinguishing plate 15A, 15B. The slit 650 forms a passage for the respective end 301, 302 of the blades 310, 320 of the movable contact 300. The slit 650 may have the general form of a lying letter V so that the apex 611 of the V is rounded. The apex 611 may form a contact point for the arc in the bottom of the slit 650. The respective end 301, 302 of the blades in the movable contact 300 may thus pass through the slit 650 when the movable contact 300 is rotated from the closed state to the open state and vice a versa.

FIG. 14 shows a side view of a permanent magnet.

The permanent magnet 510, 520 may have the form of a parallelepiped having a height H1, a width W1 and a thickness T1. The permanent magnet 510, 520 may comprise two opposite side faces connected by four edge walls. The side faces may be parallel. A cross section of the permanent magnet 510, 520 may form a rectangle or a quadrature. The height H1 and the width W1 of the permanent magnet 510, 520 would be equal in the quadrature. The two permanent magnets 510, 520 shown in the figures may be identical.

The magnetic poles in the permanent magnet 510, 520 may be arranged on the opposite side faces in the permanent magnet 510, 520. The magnetic poles of the permanent magnet 510, 520 may be arranged so that the magnetic field B of the permanent magnet 510, 520 is directed in a horizontal plane, which is shown by the two-headed arrow in the FIGS. 3, 5, 7 and 9. This horizontal plane is perpendicular to the rotational axis Z1-Z1 of the movable contact 300. The direction of the magnetic field B between the two possible alternatives, N→S or S→N, depends on which of the two opposite side faces of the permanent magnet 510, 520 is facing towards the interior of the housing 10 and which side face is facing towards the exterior of the housing 10. The permanent magnet 510, 520 may be positioned in either position within the compartment 511, 521. The magnetic field B is in both positions of the permanent magnet 510, 520 directed substantially parallel to the principal directions of the side portions 620, 630 of the extinguishing plates 15A, 15B, and perpendicular to the base portion 610 of the extinguishing plates 15A, 15B. The magnetic field B is thus directed substantially parallel to the longitudinal direction X2-X2 of the movable contact 300 in a situation in which the outer end 301, 302 of the movable contact 300 is facing towards the permanent magnet 510, 520. A straight line drawn through a center point M1 of the poles of the permanent magnet 510, 520 will be substantially parallel with the longitudinal direction X2-X2 of the movable contact 300 in a situation in which the outer end 301, 302 of the movable contact 300 is facing towards the permanent magnet 510, 520. The cross section of the permanent magnet 510, 520 may have the shape of a square, in which case there are eight available mounting positions for the permanent magnet 510, 520 within the compartment 511, 521. The permanent magnet 510, 520 will produce a magnetic field B in either of the two directions shown in the figures in any of these eight positions.

The permanent magnet 510, 520 may have a small size. The height H1 may be 10 mm and the width W1 may also be 10 mm whereas the thickness may be 2 mm. The size of the side faces in the permanent magnet 520, 520 is thus 10 mm times 10 mm and the thickness of the permanent magnet 510, 520 is 2 mm. The current I flowing through the electrical switch may be directed from the first fixed contact 100 via the movable contact 300 to the second fixed contact 200 or vice a versa. The direction of the current I may thus vary between two alternatives depending on which way the fixed contacts 100, 200 are mounted to the power supply.

The force F acting on a point charge is according to the Lorenz law directed in the thickness direction Z-Z of the housing 10 in the situation shown in the figures depending on the direction of the magnetic field B and the current I. The force F acting on the arc will thus blow the arc towards one of the side portions 620, 630 of the extinguishing plates 15A, 15B. The arc is directed within the extinguishing apparatus 14A, 14B towards the bottom 611 of the slit 650 in the extinguishing plates 15A, 15B. The arc will jump from one extinguishing plate 15A, 15B to the other and thereby loose its energy as the movable contact 300 passes through the arc extinguishing apparatus 14A, 14B. The permanent magnet 510, 520 will direct the arc towards one of the side portions 620, 630 in the extinguishing plates 15A, 15B.

FIG. 15 shows a plan view of an electrical switch according to another embodiment in an open stage and FIG. 16 shows a plan view of the electrical switch of FIG. 15 in a closed stage.

This embodiment of the electrical switch is intended for smaller currents. The movable contact 300 may be turned in a clockwise direction from the open position in FIG. 15 to the closed position in FIG. 16 and vice a versa. The electrical switch is provided with shutter elements 410, 420, but there is no extinguishing apparatus in this embodiment. The shutter elements 410, 420 are shown in the extended position in FIG. 14 i.e. the shutter elements 410, 420 are positioned between the fixed contact 100, 200 and the movable contact 300. The shutter elements 410, 420 will thus close the direct path from the fixed contact 100, 200 to the movable contact 300, whereby the arc between the fixed contact 100, 200 and the movable contact becomes extinguished. The shutter elements 100, 200 are shown in the contracted position in FIG. 15 i.e. the shutter elements 410, 420 are positioned outside the patch of the movable contact 300 allowing the movable contact 300 to turn from the open position to the closed position. One end 411, 421 of the shutter element 410, 420 is attached with an articulated joint J10, J20 to the housing 10. The shutter element 410, 420 may thus rotate or turn around the articulated joint J10, J20. The shutter elements 410, 420 may be connected with a transmission gear to the movable contact 300 so that rotation of the movable contact 300 causes rotation of the shutter elements 410, 420. The shutter elements 410, 420 move in synchronism with the movable contact 300.

The invention is not restricted to the electrical switch 700 shown in the figures.

The electrical switch 700 could be modified so that the movable contact 300, instead of being rotatable, would be linearly movable. The fixed contacts 100, 200 could be positioned opposite to each other as in the figures, but the movable contact 300 could move linearly in a direction perpendicular to a straight line connecting the fixed contacts 100, 200. The ends 301, 302 of the movable contact 300 would in the closed position contact a respective fixed contact 100, 200. The ends 301, 302 of the movable contact 300 would in the open position be at a distance from a respective fixed contact 100, 200.

The electrical switch 700 could on the other hand be modified so that the rotational axis Z1-Z1 of the movable contact 300, instead of being positioned in the middle portion 350 of the movable contact 300, would be positioned at either outer end 301, 302 of the movable contact 300. The second fixed contact 200 could be attached via an articulated joint to the rotational axis Z1-Z1 of the movable contact 300 at the second outer end 302 of the movable contact 300. The movable contact 300 would then rotate around this articulated joint forming the rotational axis Z1-Z1 of the movable contact 300 between a closed position and an open position. The first outer end 301 of the movable contact 300 would contact the first fixed contact 100 in the closed position. The first outer end 301 of the movable contact 300 would be rotated away to a distance from the first fixed contact 100 in the open position. Only one extinguishing apparatus 14A and only one permanent magnet 510 would then be needed. The first end 301 of the movable contact 300 would pass through the first extinguishing apparatus 14A when turning from the closed position to the open position and vice a versa. There would thus be a constant electrical connection between the movable contact 300 and the second fixed contact 200.

The electrical switch 700 could further be modified so that the electrical switch comprises three fixed contacts and a movable contact. Two fixed contacts could be positioned adjacent to each other on the side of the housing 10 where the first fixed contact 100 is shown in the figures. The third fixed contact could be positioned on the opposite side of the housing 100 i.e. on the side where the second fixed contact 200 is positioned in the figures. The movable contact 300 could be a rotatable contact positioned in the middle of the housing 10 as in the figures. A middle portion 350 of the movable contact 300 could be permanently electrically connected to the third fixed contact e.g. with a twisted flexible cable. The electrical switch could be a change-over switch in which the movable contact 300 may in a first switching position form an electrical connection between the first fixed contact and the third fixed contact and in second switching position between the second fixed contact and the third fixed contact. A main power supply could be connected to the first fixed contact and an emergency power supply could be connected to the second fixed contact. The load could be connected to the third fixed contact. The movable contact would thus in a normal operational situation connect the main power supply to the load and in a black-out situation the emergency power supply to the load.

FIGS. 6-9 show an embodiment of the electrical switch comprising permanent magnets 510, 520 and shutter elements 410, 420. The permanent magnets 510, 520 are to be seen as a further option in the invention. The basic inventive concept is based on an electrical switch provided with shutter elements 410, 420 i.e. without permanent magnets 510, 520.

The movable contact 300 may be any kind of movable contact. A movable contact 300 provided with a least one pair of blades 310, 320 is one advantageous type of movable contact suitable for the embodiments shown in the figures. The movable contact 300 should provide for an electrical connection between the two fixed contacts 100, 200 in the closed position. The movable contact 300 should on the other hand provide for an electrical isolation between the fixed contacts 100, 200 in the open position.

FIGS. 6-9 show an embodiment in which there is a separate single extinguishing plate 15A, 15B positioned on the fixed contact 100, 200. The outer ends 310, 302 of the movable contact 300 pass only partly through said separate single extinguishing plate 15A, 15B when the movable contact 300 moves between the closed position and the open position. This separate single extinguishing plate 15A, 15B does not as such form a part of the actual main extinguishing apparatus 14A, 14B.

The embodiments shown in the figures could also be modified so that one or several separate extinguishing plates 15A, 15B would be positioned after the permanent magnet 510, 520 in the opening direction of the movable contact 300. These separate extinguishing plates 15A, 15B would not as such form part of the actual main extinguishing apparatus 14A, 14B.

The housing 10 and the roller 80 may be made of a non-conducting material or electrically isolating material, e.g. of plastic.

The first and the second compartments 511, 521 for the permanent magnets 510, 520 may be made of non-conducting material or electrically isolating material. The first and the second compartments 511, 521 may be formed as an integral part of the housing 10.

The shutter elements 410, 420 may be made of a non-conducting material or electrically isolating material, e.g. of plastic.

The extinguishing plates 15A, 15B in both extinguishing apparatuses 14A, 14B may be made of a magnetically conducting material e.g. of metal and preferably of steel.

Each of the permanent magnets 510, 520 may be e.g. a neodymium magnet. A neodymium magnet (also known as NdFeB, NIB or Neo magnet) is a widely used type of rare-earth magnet. A neodymium magnet is a permanent magnet made from an alloy of neodymium, iron and boron to form the $Nd_2Fe_{14}B$ tetragonal crystalline structure.

The fixed contacts 100, 200 as well as the movable contact 300 i.e. the blades 310, 320 in the movable contact 300 may be of an electrically conductive material, e.g. pure copper (Cu). The copper in these contacts may be coated with silver (Ag). The silver coating may reduce the contact resistance and protect the copper from oxidation.

A multiphase electrical switch may be formed by placing several electrical switches 700 together to form a modular package of electrical switches 700. The rotational axis Z1-Z1 of each movable contact 300 will coincide in such a solution. The electrical switches 700 may be connected to each other through the roller 80 of the movable contact 300. A first end of the roller 80 may extend at a distance from the surface plane of the housing 10, and the other opposite end of the roller 80 may substantially remain in the surface plane of the housing 10. The first end of the roller 80 may comprise a cylindrical outer end with a first tooth engagement on the outer circumference. The other end of the roller 80 may in a corresponding way comprise a cylindrical recess with a second tooth engagement on the periphery of the recess. When two adjacent electrical switches 700 are coupled together, the first protruding end of the roller 80 in the first electrical switch 700 is positioned in the second recess of the roller 80 of the second electrical switch 700 so that the teeth engage with each other. The rollers 80 of both electrical switches 700 are thus interconnected so that they rotate synchronously.

A multiphase electrical switch may on the other hand be formed in a common casing being divided with intermediate walls into adjacent housings 10 as shown in FIG. 10. The adjacent housings 10 form compartments in the casing. The rotational axis Z1-Z1 of each movable contact 300 may coincide also in such a solution.

An electrical switch 700 according to the invention may be an automatic electric switch, the movable contact 300 being rotated through an actuator. The actuator may be, for example, a solenoid whose linear movement is converted into a rotational motion by means of a power transmission apparatus. The power transmission apparatus may rotate the roller 80 from the zero position clockwise or counterclockwise and thereby move the movable contact 300 between the contact positions. The actuator may also comprise a spring for returning the movable contact 300 to the zero position.

The invention and its embodiments are not limited to the examples shown in the figures, but the invention may vary within the scope of the protection defined by the claims.

The invention claimed is:

1. An electrical switch comprises a first fixed contact and a second fixed contact positioned opposite to and at a distance from the first fixed contact, a movable contact having a rotational axis positioned in a middle portion of the movable contact, the rotational axis of the movable contact being positioned between the first fixed contact and the second fixed contact, the movable contact being rotatable between a closed position in which a first outer end of the movable contact makes contact to the first fixed contact and a second outer end opposite to the first outer end of the movable contact makes contact to the second fixed contact and an open position in which the movable contact is electrically isolated from the first fixed contact and the second fixed contact, a first shutter element positioned in connection with the first fixed contact, a second shutter element positioned in connection with the second fixed contact, each shutter element being movable in synchronism with the movable contact between an extended position in which the shutter element is positioned between a respective fixed contact and the movable contact when the movable contact is in the open position, and a contracted position in which the shutter element is positioned outside a path of the movable contact to turn from the open position to the closed position.

2. The electrical switch according to claim 1, wherein the rotatable contact comprises at least one pair of longitudinal blades being flexible connected to each other.

3. The electrical switch according to claim 2, wherein a contact portion of the first fixed contact is received between the blades in a first outer end of the rotatable contact and a contact portion of the second fixed contact is received between the blades in a second outer end of the rotatable contact when the electrical switch is in the closed position.

4. The electrical switch according to claim 1, wherein a first extinguishing apparatus is positioned after the first fixed contact in the opening direction of the rotatable contact, a second extinguishing apparatus is positioned after the second fixed contact in the opening direction of the rotatable contact.

5. The electrical switch according to claim 4, wherein each shutter element is in the extended position positioned between the respective fixed contact and a respective extinguishing apparatus when the rotatable contact is in the open position and in the contracted position positioned outside the path of the movable contact allowing the movable contact to turn from the open position to the closed position.

6. The electrical switch according to claim 4, wherein a first permanent magnet is positioned after the first extinguishing apparatus in the opening direction of the rotatable contact, a second permanent magnet is positioned after the first extinguishing apparatus in the opening direction of the rotatable contact.

7. The electrical switch according to claim 1, wherein the fixed contacts and/or the movable contact and/or the extinguishing apparatuses and/or the permanent magnets are enclosed in a housing comprising two opposite side panels and four side walls connecting peripheral edges of the side panels, a connection portion of the first fixed contact passing through a first side wall and a connection portion of the second fixed contact passing through a second side wall being opposite to and spaced apart from the first side wall in a longitudinal direction of the housing.

8. The electrical switch according to claim 7, wherein the movable contact is supported on a rotatable roller and the roller is rotatable supported in the side panels of the housing.

9. The electrical switch according to claim 8, wherein an inner end of the shutter element is supported with an articulated joint on the roller.

10. The electrical switch according to claim 9, wherein an outer end of the shutter element is positioned in guide grooves formed in the side panels of the housing.

* * * * *